US005858310A

United States Patent [19]

Jackson et al.

[11] Patent Number: 5,858,310

[45] Date of Patent: Jan. 12, 1999

[54] MODIFIED SLOPING TEST TUBE

[75] Inventors: Milton Jackson, 4113 Chester Dr., No. 212, Ypsilanti, Mich. 48197; Michael Bacon, Davie, Fla.

[73] Assignee: Milton Jackson, Ypsilanti, Mich.

[21] Appl. No.: 848,130

[22] Filed: Apr. 28, 1997

Related U.S. Application Data

[63] Continuation-in-part of Ser. No. 762,773, Dec. 10, 1996.

[51] Int. Cl.[6] ..... B01L 3/00

[52] U.S. Cl. ..... 422/102; 422/99; 422/104

[58] Field of Search ..... 422/58, 59, 61, 422/99, 102, 104

[56] References Cited

U.S. PATENT DOCUMENTS

| | | | |
|---|---|---|---|
| D. 296,928 | 7/1988 | Lee et al. | D24/32 |
| 1,312,340 | 8/1919 | Mojonnier | 422/100 |
| 1,660,974 | 2/1928 | Porro | 422/102 |
| 2,288,065 | 6/1942 | Benotti | 422/102 |
| 2,625,823 | 1/1953 | Erickson | 422/102 X |

OTHER PUBLICATIONS

VWR Scientific catalog, p. 210, showing Nunclon™ Δ flat sided and culture tubes.

Corning Glassware catalog, 1995, p. 265, showing tube with flat window and showing tube with sidearm.

James W. Queen and Co. catalog, circa 1875, pp. 22–23, showing side neck test tube and ignition tube.

*Primary Examiner*—Harold Y. Pyon

*Attorney, Agent, or Firm*—David P. Gordon; David S. Jacobson; Thomas A. Gallagher

[57] ABSTRACT

A modified test tube is provided which can sit on any flat surface unaided by a test tube rack. The modified test tube is an elongate, substantially tubular member having a containment portion coupled to the neck portion. The containment portion has a bottom surface and a closed end. The neck portion is angled relative to the flattened surface and has a mouth. A sloped surface is provided at the interior of the tubular member coextensive with the flattened surface. The bottom surface of the modified test tube enables the test tube to sit prone on any flat surface by itself, unaided by a rack, and the bent neck portion prevents the contents from spilling from the test tube. This design enables the contents within the test tube to be easily monitored without moving the test tube.

14 Claims, 4 Drawing Sheets

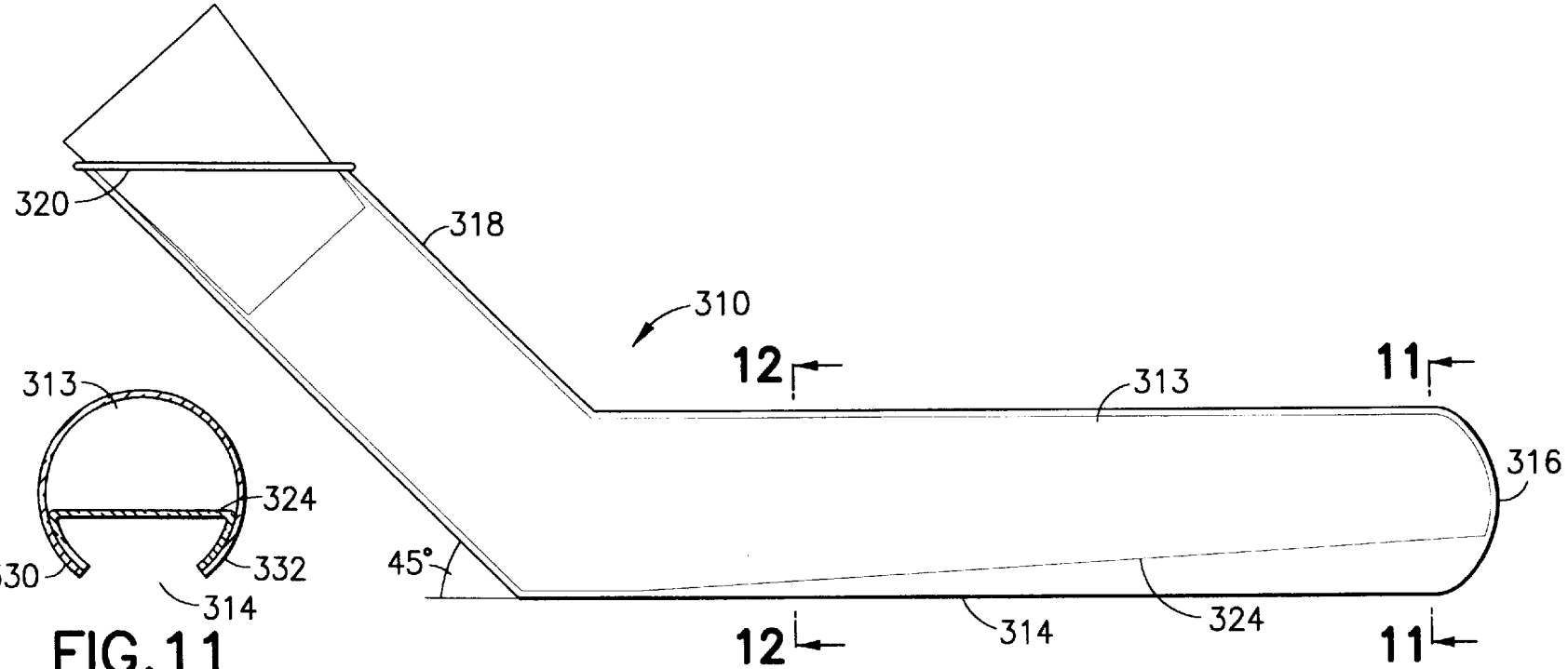
FIG. 10
FIG. 11
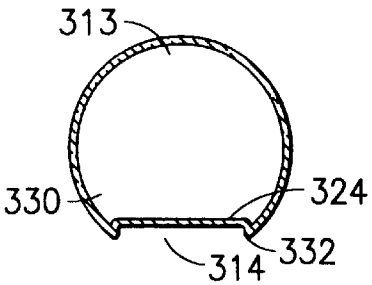
FIG. 12

MODIFIED SLOPING TEST TUBE

This application is a continuation-in-part of U.S. Ser. No. 08/762,773, filed Dec. 10, 1996, which is hereby incorporated by reference herein in its entirety.

BACKGROUND OF THE INVENTION

1. Field of the Invention

This invention relates broadly to laboratory equipment. More particularly, this invention relates to test tubes.

2. State of the Art

Standard test tubes are tubular in shape and have a rounded sealed bottom end and an open top end. The standard test tube design possesses a high degree of utility in laboratory experimentation and research. In fact, it is anticipated that the standard shape test tube will continue to dominate the test tube market due to its simplicity and design familiarity. Yet, this dominance is in spite of drawbacks associated with the standard design.

As a result of the shape of the standard design test tube, standard test tubes require the use of a rack for support, as the tubes cannot stand on their own. In addition, unless the open end of a standard design test tube is closed with a stopper, when the tube is placed on a surface, the contents of the tube will spill out. Therefore, standard design test tubes, regardless of size, generally require the use of a test tube rack to hold the test tubes while being utilized. In addition, when placing a standard test tube into a heated water bath, the standard test tube must first be placed into a test tube rack and then the entire rack must be inserted into the water, such that the standard test tubes are substantially submerged. This results in more time and energy needed to bring the contents of the standard test tubes to the desired temperature. Furthermore, as a substantial portion of the standard test tube is submerged in the water bath, it is difficult to monitor reactions occurring within the test tube. Moreover, when applying heat to a standard test tube, it is common to place the test tube in a clamp and to apply a flame under the test tube. This often provides uneven heating of the contents, as heat is applied primarily only under the bottom of the test tube, and the contents at the bottom of the tube may scorch while the contents higher up in the test tube are not effectively heated. Likewise, standard test tubes cool slowly as cool air will only come into contact with a small surface area of the contents of the tube. In addition, when adding or heating reagents in a standard test tube there is a strong potential for harmful spatter from "bumping" (the rapid evolution of gas bubbles) to occur which can result in sample loss. Furthermore, when adding a substance to a test tube in situations where the substance weight is critical, the substance must first be weighed on weighing paper and then transferred into the test tube. The use of weighing paper results in a loss of substance, as some amount of substance still remains on the weighing paper after the substance has been transferred into the test tube.

SUMMARY OF THE INVENTION

It is therefore an object of the invention to provide a test tube which can be seated in a stable position without the use of a test tube rack, and can also be stood vertically in a conventional test tube rack.

It is another object of the invention to provide a test tube which urges its contents to a location relative to the mouth of the test tube such that pipetting of the contents of the test tube can be easily performed.

It is a further object of the invention to provide a test tube which will not spill when prone.

It is yet another object of the invention to provide a test tube which allows relatively easy monitoring of the contents of the test tube.

It is an additional object of the invention to provide a test tube which permits even heating and cooling of its contents.

In accord with these objects which will be discussed in detail below, a modified test tube is provided which can sit on any flat surface unaided by a test tube rack. The modified test tube is an elongate, substantially tubular member defining a containment portion and a neck portion. The containment portion has a flattened bottom surface and a closed end and the neck portion has a mouth. The neck portion is angled approximately 45° relative to the flattened bottom surface and the mouth opens parallel to the flattened bottom surface. A sloped channel is provided at the interior of the tubular member coextensive with the flattened bottom surface.

It will be appreciated that the flattened bottom surface of the modified test tube enables the test tube to sit on any flat surface by itself, unaided by a rack, and that the bent mouth portion prevents the contents from spilling from the test tube. Additionally, the modified test tube may be used in the vertical position and is, accordingly, compatible with standard test tube racks and other conventional laboratory equipment. It will also be appreciated that this design enables the contents within the test tube to be easily monitored and observed without moving the test tube, which is usually required when a test tube is seated in a rack. The modified test tube may also be placed directly into a water bath without the use of rack. In addition, the contents of the modified test tube may be more evenly heated as heating can be done with the modified test tube in a prone orientation and potentially harmful spatter from "bumping" is reduced, and heated contents cool more rapidly and evenly. Furthermore, an empty modified test tube can easily be placed on a zero balance scale and contents can be added directly to the test tube without the necessity of weighing paper.

Additional objects and advantages of the invention will become apparent to those skilled in the art upon reference to the detailed description taken in conjunction with the provided figures.

BRIEF DESCRIPTION OF THE DRAWINGS

FIG. 10 is a side elevation view of a fourth embodiment of a modified test tube according to the invention;

FIG. 11 is a cross-section across line 11—11 of FIG. 10; and

FIG. 12 is a cross-section across line 12—12 of FIG. 10.

DETAILED DESCRIPTION OF THE PREFERRED EMBODIMENTS

Figure 1:
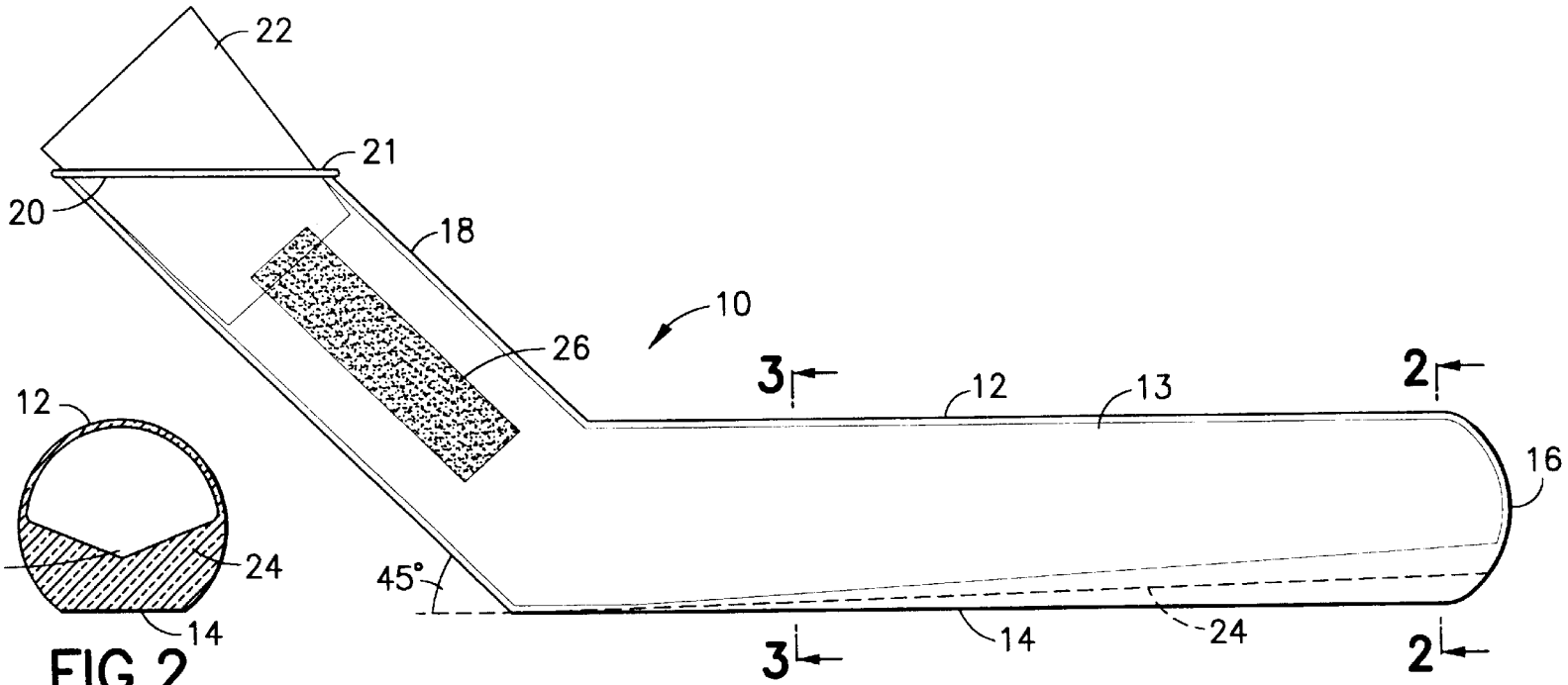
FIG. 1 is a side elevation view of the modified test tube of the invention.
Figure 2:
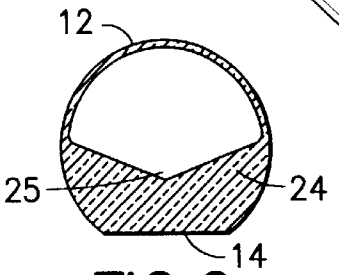
FIG. 2 is a cross-section across line 2—2 of FIG. 1.
Figure 3:
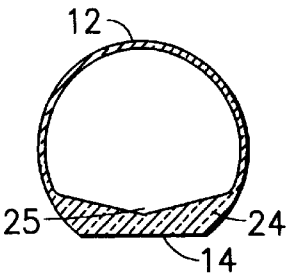
FIG. 3 is a cross-section across line 3—3 of FIG. 1.

Turning now to FIG. 1, a preferred embodiment of the modified test tube 10 of the invention is shown. The modified test tube 10 includes a containment portion 13 coupled to a neck portion 18. The test tube 10 is preferably made of glass or transparent plastic. The containment portion 13 defines a non-circular cross section and preferably has a flattened bottom surface 14 and a closed end 16. The neck portion 18 is angled upwards approximately 45° relative to the flattened bottom surface 14 and has a mouth 20 parallel to the flattened bottom surface. The mouth 20 preferably has a lip 21. The mouth can be sealed with a standard rubber stopper 22. Alternatively, the mouth can be provided with external threads (not shown) which receive a threaded cap (not shown). Referring to FIGS. 1, 2 and 3, the interior of the containment portion has a surface 24 sloped relative to the flattened bottom surface 14, sloping upward from the neck portion 18 to the closed end 16, and also sloped laterally inward, thereby defining a sloped channel 25. It will be appreciated that the extra material required to slope surface 24 upwards provides a gradual increase in mass toward the closed end 16, counterbalancing the upwardly angled neck portion 18 which overextends the flattened surface. A roughened patch 26 (or frosted patch) is provided on the surface of the neck portion 18 providing a surface on which to mark the test tube with a pen or pencil.

Figure 4:
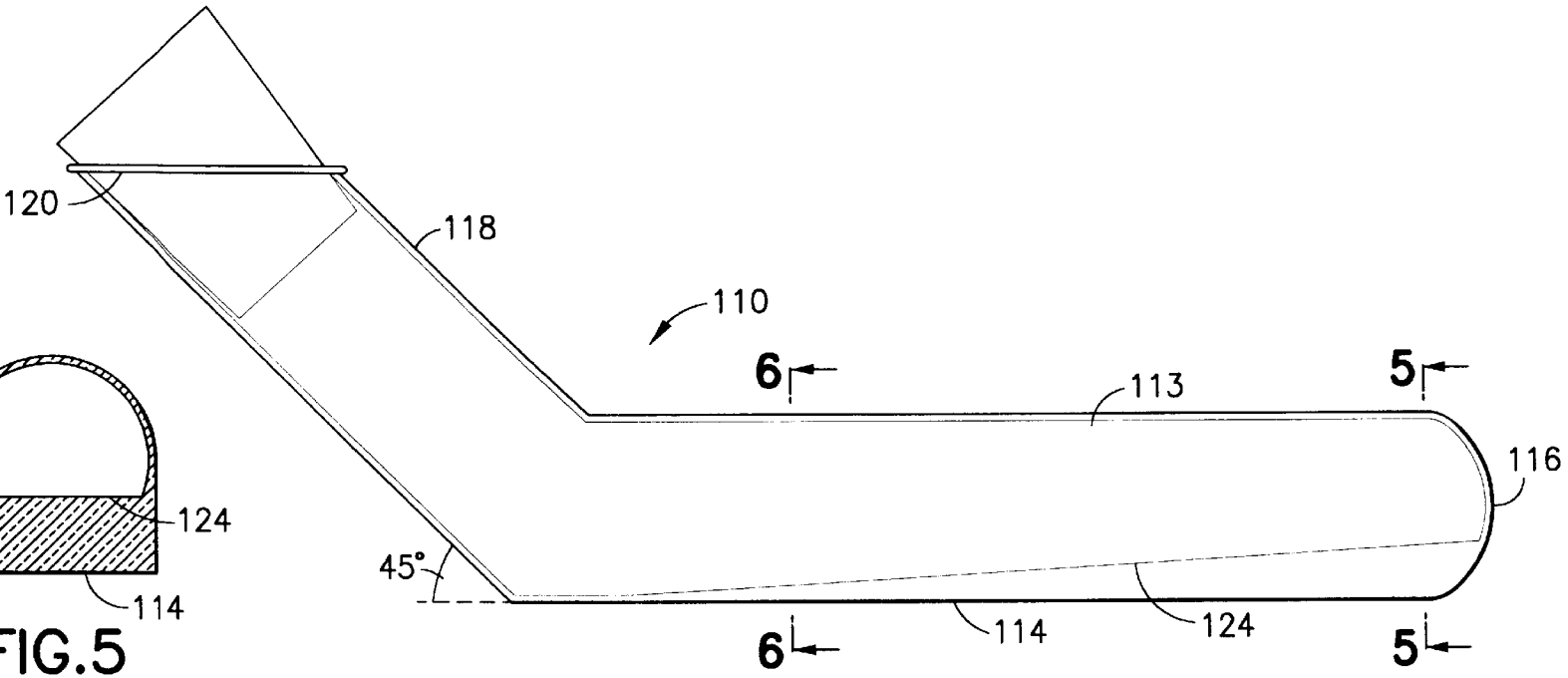
FIG. 4 is a side elevation view of a second embodiment of a modified test tube according to the invention.
Figure 5:
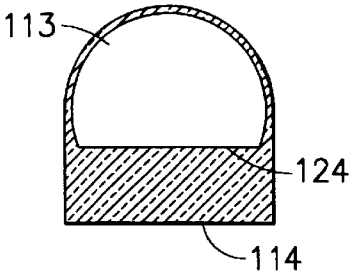
FIG. 5 is a cross-section across line 5—5 of FIG. 4.
Figure 6:
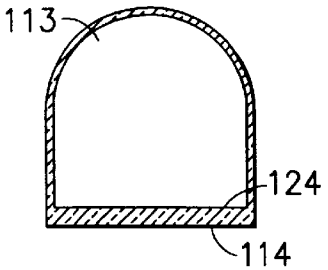
FIG. 6 is a cross-section across line 6—6 of FIG. 4.

Turning to FIGS. 4, 5, and 6, a second embodiment, substantially similar to the first embodiment (with numbers increased by 100 referring to similar parts), is shown. The modified test tube 110 includes a containment portion 113 coupled to a neck portion 118. The containment portion 113 has a flattened bottom surface 114 and a closed end 116, and the neck portion 118 is angled upwards, preferably 45°, relative to the flattened surface and terminates in a mouth 120. The containment portion includes a substantially flat surface 124 which slopes upward relative to and coextensive with the flattened surface 114. The slope 124 provides a gradually increased mass toward the closed end, counterbalancing the upwardly angled neck portion 118 which overextends the flattened bottom surface, and urges material held within the containment portion towards the neck portion.

Figure 7:
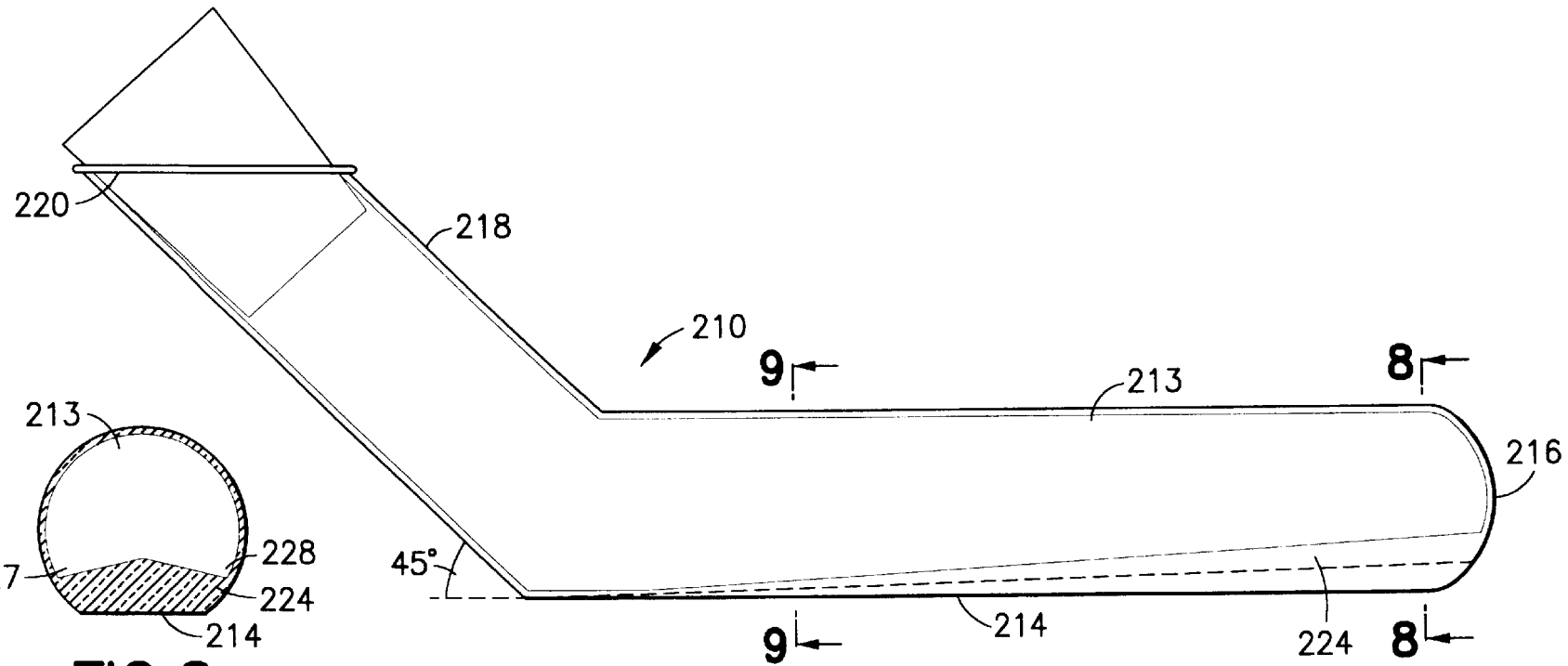
FIG. 7 is a side elevation view of a third embodiment of a modified test tube according to the invention.
Figure 8:
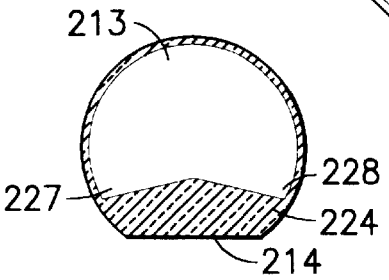
FIG. 8 is a cross-section across line 8—8 of FIG. 7.
Figure 9:
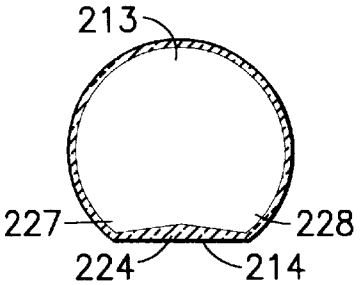
FIG. 9 is a cross-section across line 9—9 of FIG. 7.

Referring to FIGS. 7, 8, and 9, a third embodiment, substantially similar to the first embodiment (with numbers increased by 200 referring to similar parts), is shown. The modified test tube 210 includes a containment portion 213 coupled to a neck portion 218. The containment portion 213 has a flattened bottom surface 214 and a closed end 216, and the neck portion 218 is angled upwards, preferably 45°, relative to the flattened surface and terminates in a mouth 220. The interior of the containment portion has a surface 224 sloped relative to the flattened bottom surface 214, sloping upward from the neck portion 218 to the closed end 216, and also sloped laterally upwards, thereby defining a sloped peaked channel 225. The sloped peaked channel 225 provides two side channels 227, 228 which meet toward the neck portion 218.

Turning to FIGS. 10, 11, and 12, a fourth embodiment, substantially similar to the third embodiment (with numbers increased by 100 referring to similar parts), is shown. The modified test tube 310 includes a containment portion 313 coupled to a neck portion 318. The containment portion 313 has a crimped bottom 314 and a closed end 316. The neck portion 318 is angled upward relative to the crimped bottom and includes a mouth 320. The crimped bottom 314 includes a sloped surface 324, sloping upwards from the neck portion 318 to the closed end 316, and two leg portions 330, 332. It will be appreciated by those skilled in the art that the bottom may be crimped during the manufacturing process when the glass or plastic is warm and malleable.

It will be appreciated in each of the embodiments of a modified test tube that the flattened surface or legs enable the test tube to sit prone on any flat surface by itself, unaided by a rack, and that the bent mouth portion prevents the contents from spilling from the test tube while prone. It will also be appreciated that this design enables the contents within the test tube to be easily monitored without moving the test tube, as the contents may easily be observed with the test tube in the prone position. The test tube may also be placed directly into a water bath without the use of rack. In addition, the contents of the test tube may be more evenly heated as heating can be done with the test tube in a prone orientation, "bumping" and its potentially harmful spatter is reduced, and heated contents can cool more rapidly and evenly. Another benefit is that the tube filled with contents can be placed, unaided, directly on a hot plate. Furthermore, an empty test tube can easily be placed prone on a zero balance scale and contents can be added directly to the test tube without the necessity of weighing paper. Moreover, the sloped surface urges the contents of the test tube to pool in a region accessible for pipetting. As such, a number of advantages are realized over the standard test tube design.

There have been described and illustrated herein several embodiments of a test tube. While particular embodiments of the invention have been described, it is not intended that the invention be limited thereto, as it is intended that the invention be as broad in scope as the art will allow and that the specification be read likewise. Thus, while glass and plastic have been disclosed as materials for constructing the test tube, it will be appreciated that other transparent materials may be used as well. Also, while a stopper and a screw top have been disclosed for sealing the test tube, it will be understood that other sealing means can be similarly used. For example, the mouth can be modified for an aerobic/anaerobic cap if desired. In addition, the inside of the containment portion can be circular, oval, or otherwise shaped. Furthermore, the connection between the containment and neck portions can be as shown or curved. Moreover, while the neck is disclosed to angle upwards approximately 45° relative to the flattened bottom surface or to the legs, it will be appreciated that the angle may be greater than or less than 45°, as the exact angle is not critical. Rather, what is critical is that the angle of the neck portion relative to the containment portion in conjunction with the length of the neck relative to the length of the containment portion should provide a test tube which can be seated in a stable position on its flattened bottom surface or legs and further provide a mouth location that will prevent the test tube contents from spilling therefrom when the test tube is seated. Also, the diameter of the neck and containment portions can be substantially the same or different, and may incorporate one or more sidearms. In addition, the mouth opening or lip can be angled relative to or parallel with the flat bottom surface. Moreover, while particular configurations have been disclosed in reference to the sloping surface, it will be appreciated that other configurations could be used as well. For example, while the slope is shown as being either flat or having an angular peak or channel, it will be appreciated that the slope may have a smoothly curved bevel. It will therefore be appreciated by those skilled in the art that yet other modifications could be made to the provided invention without deviating from its spirit and scope as so claimed.

We claim:

1. A test tube, comprising:

a) a tubular body portion having a containment portion and a closed end, said containment portion having an interior surface, and an exterior surface, said exterior surface having an upper portion defining a substantially horizontal axis on said upper portion, and a lower portion substantially parallel to said upper portion, and said exterior surface defining a non-circular cross-section, said lower portion of said exterior surface seating said test tube on a flattened surface, said interior surface and said exterior surface defining a lower wall therebetween which gradually changes in thickness in the direction of said closed end to said tubular neck portion such that said interior surface slopes relative to said lower portion of said exterior surface, said lower wall being thickest adjacent said closed end, and said closed end having a cross-sectional area equal to or smaller than a cross-sectional area through said containment portion; and b) a tubular neck portion having an open end with a center, said neck portion coupled at an angle relative to said containment portion such that said center is vertically displaced above said horizontal axis of said upper portion of said exterior surface when said test tube is seated on the flattened surface.

2. A test tube according to claim 1, wherein:

said interior surface is substantially planar.

3. A test tube according to claim 1, wherein:

said interior surface is convex.

4. A test tube according to claim 1, wherein:

said interior surface is concave.

5. A test tube according to claim 1, wherein:

said neck portion is angled approximately 45° relative to said containment portion.

6. A test tube according to claim 1, wherein:

said test tube is made of one of glass and plastic.

7. A test tube according to claim 1, wherein:

said test tube is made of a transparent material.

8. A test tube according to claim 1, wherein:

said exterior surface includes a substantially planar portion.

9. A test tube according to claim 1, wherein:

said exterior surface includes two longitudinal legs.

10. A test tube according to claim 8, wherein:

said interior surface is substantially planar.

11. A test tube according to claim 8, wherein:

said interior surface is concave.

12. A test tube according to claim 8, wherein:

said sloped interior surface is convex.

13. A test tube according to claim 8, wherein:

said test tube is made of one of glass and plastic.

14. A test tube according to claim 8, wherein: said test tube is made of a transparent material.

* * * * *